United States Patent [19]

Detonnancourt

[11] 4,051,873

[45] Oct. 4, 1977

[54] WEFT YARN CARRIER

[75] Inventor: Maurice J. Detonnancourt, Lincoln, R.I.

[73] Assignee: Owens-Corning Fiberglas Corporation, Toledo, Ohio

[21] Appl. No.: 746,929

[22] Filed: Dec. 2, 1976

[51] Int. Cl.[2] ..... D03D 47/02

[52] U.S. Cl. ..... 139/440

[58] Field of Search ..... 139/429, 433, 440, 441, 139/442, 447, 448

[56] References Cited

U.S. PATENT DOCUMENTS

| | | | |
|---|---|---|---|
| 164,949 | 6/1875 | Turpie | 139/447 |
| 446,177 | 2/1891 | Wyman et al. | 139/440 |
| 3,347,284 | 10/1967 | Kokkiuis | 139/447 |

*Primary Examiner*—Henry S. Jaudon
*Attorney, Agent, or Firm*—Ronald C. Hudgens; Philip R. Cloutier; Greg Dziegielewski

[57] ABSTRACT

The invention concerns an improved weft yarn carrier or rapier needle for use on a shuttleless loom where the weft yarn is supplied from a stationary source located outside of the warp yarns and passes through an aperture in the carrier or needle.

4 Claims, 5 Drawing Figures

WEFT YARN CARRIER

BACKGROUND OF THE INVENTION

In shuttleless looms that is, those looms in which the weft yarn is continuously supplied from a stationary source located outside the lateral limits of the warp yarns of the shed, it is customary to insert the weft yarn by means of a reciprocable inserter. In one such shuttleless operation a supply of weft yarn is located adjacent one side of the loom and the picks are drawn from the source and inserted into the shed formed by the warp yarns. The insertion is effected by means of an inserter carrier, or rapier type needle, which is moved into, and from, the shed by means of the reciprocable inserter.

During operation, the weft yarn is pulled from the source outside the shed and is led or passed through an aperture or eye in the carrier or needle. On the insertion and withdrawal strokes of the carrier or needle the weft yarn makes sliding contact with an edge, or edges, of the aperture of the needle.

Due to the sliding advancement of the yarn through the eye of the needle the yarn and/or the needle eye may be damaged. It has been found that when employing fiberous glass strand as the weft yarn, a conventional rapier needle can become hot enough to melt or scorch certain synthetic polymer warp yarns in some instances, if the needle should touch the warp yarns.

SUMMARY OF THE INVENTION

This invention, an improved weft yarn carrier or rapier needle, comprises a needle having a rotatable member or pulley (or tandem rotatable members or pulleys) positioned in an aperture in the needle through which the weft yarn is drawn. The positioning of the pulley or pulleys within the eye of the needle reduces or eliminates the sliding contact between the weft yarn and the eye of the needle. Therefore, it is object of this invention to provide and improved inserter carrier which will reduce or eliminate the wear or damage to the needle and/or weft yarn as it passes through the eye of the needle.

An additional object of this invention is to provide an improved inserter carrier needle that will reduce or eliminate the tendency of the needle to over-heat during operation when employing fiberous glass weft yarns.

Other objects and advantages of this invention will be obvious and explained by reference to the accompanying specification and drawings.

DESCRIPTION OF THE INVENTION

Figure 1:
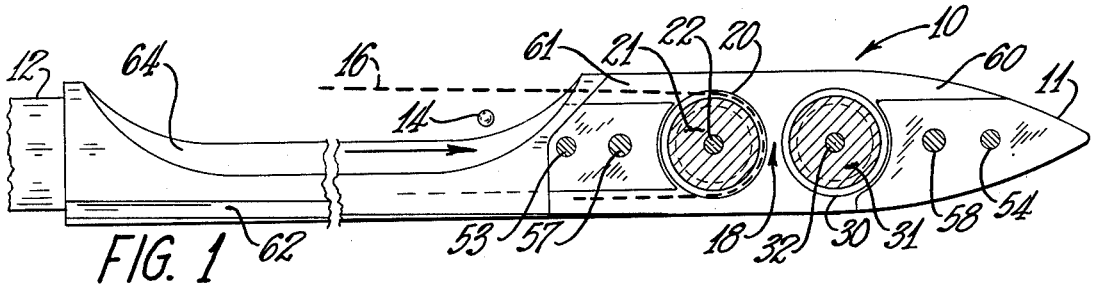
FIG. 1 is a partial section of a plan view of the rapier needle and shows the position of the weft yarn during the insertion stroke.
Figure 2:
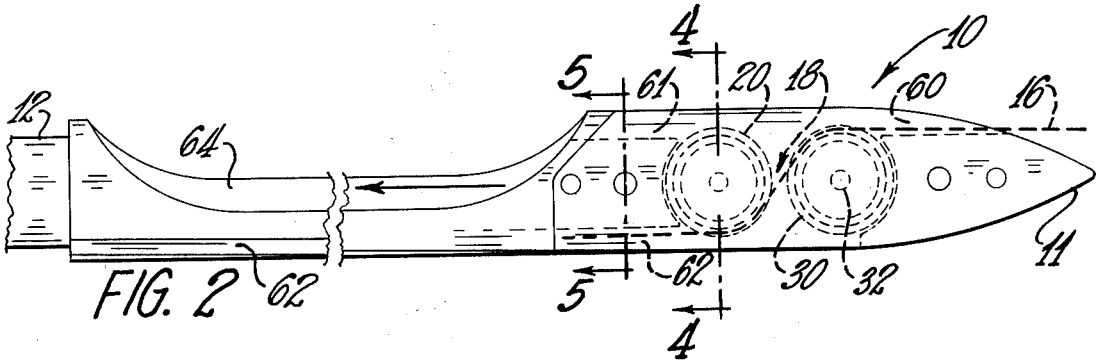
FIG. 2 a plan view of the needle showing the location of the weft yarn during the withdrawal stroke.
Figure 3:
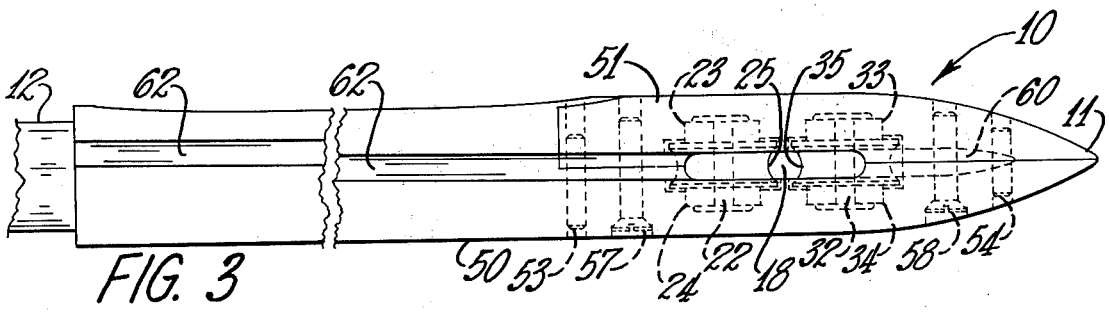
FIG. 3 is a side elevation view of the needle.

As shown in FIGS. 1, 2 and 3, the insertion carrier 10 is fixed to reciprocable member 12. Member 12 can be a rod connected to any means (not shown) for moving or reciprocating the member 12, for example a piston type arrangement or any other suitable means well known in the art.

During operation, the carrier 10 moves or reciprocates approximately over the width of the fabric through the shed formed by the warp yarns. At each edge, or selvage, of the fabric being woven, a pin 14 is positioned along the line defined by the fell of the cloth to receive the temporarily hold the weft yarn 16.

As with a conventional rapier needle, pin 14, which is attached to the loom frame (not shown), is positioned within recess 64 and the loop formed by the weft yarn 16 at the end of the insertion stroke, as can be seen in FIG. 1. The weft yarn is looped around pin 14 to hold the weft yarn 16 in position as the needle reverses direction or withdraws through the shed. With the weft yarn held by pin 14 at the selvage of the non-insertion side of the fabric and the needle fully retracted, another pin 14, which is also attached to the frame and located along the line of the fell of the cloth but on the opposite side of the fabric as the other pin 14, is positioned to the side of weft yarn 16 and in front of needle 10 such that, as the needle is inserted into the shed, the weft yarn is looped around pin 14 at the insertion side of the fabric to hold the weft yarn 16 in position. That is, the functional relationship between the holding pin 14 and needle 10 at each selvage is essentially the same as with a conventional type rapier needle.

In such a loom, a double pick are deposited per cycle of the needle 10. After the reed has beaten-up or struck the weft yarn into position in the fabric, the cycle of the insertion and withdrawal of the needle is repeated.

In shuttleless looms, the weft yarn supply or source is usually stationary and is located outside the shed at the insertion side thereof. And, as shown in FIG. 1, the weft yarn source is located along the left-hand selvage of the fabric, and during the insertion stroke the needle 10 moves from left to right. With one end of the yarn 16 fixed relative to the fabric and the other end of yarn 16 advancing from the yarn source (not shown), the weft yarn 16 will be advanced or moved through the aperture, or eye 18, of needle 10 from the yarn source as the needle reciprocates.

As shown in FIG. 1, the weft yarn 16 loops through eye 18 during the insertion stroke. Rotatable member or pulley 20 is located along an edge of aperture or eye 18 and is adapted to receive or contact weft yarn 16 during the insertion stroke. Disk-like element 21 is fixed to shaft 22 which is journaled in bearings 23 and 24 which are located in needle components 51 and 50 respectively.

Rotatable member or pulley 30 is located along an edge of aperture 18 opposite pulley 20 and is adapted or oriented to receive or contact the weft yarn 16 during the withdrawal stroke. As can be seen in FIG. 2, pulleys 20 and 30 are oriented and adapted to receive or contact the weft yarn 16 during the withdrawal stroke. As the yarn 16 passes through eye 18 during the withdrawal stroke, the yarn contacts opposite zones on pulleys 20 and 30 to assume an "S" shaped path through the needle 1 as shown in FIG. 2. The surfaces of circumferential grooves 25 and 35 of pulleys 20 and 30, respectively move with the weft yarn thereby eliminating or reducing the damage to the needle 10 and yarn 16 otherwise caused by the sliding contact between the yarn and needle.

Needle components 50 and 51 are affixed relative to each other by guide pins 53 and 54 and are fastened together by screws 57 and 58. Each of the components 50 and 51 has a recess which combine when the various parts are assembled to form aperture or eye 18.

Figure 5:
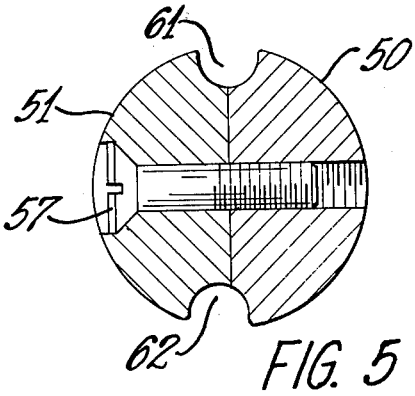
FIG. 5 is a cross-sectional view taken along section line 5—5 FIG. 2

Slots or grooves 60, 61 and 62 in the surface of the needle 10 permit weft yarn 16 to pass through the needle 10 with a minimum of contact therewith except for that contact with the pulleys. Grooves 60, 61 and 62 enable the pulleys to be entirely recessed within the perimeter of needle components 50 and 51. Groove 60 extends along the length of the needle from aperture 18 to exterior surface of the conically shaped tip 11 of the needle. Groove 61 extends along the length of the needle from aperture 18 to recess 64. Recess 64 accomodates pin 14 at the end of the insertion stroke. Pin 14 temporarily holds the weft yarn 16 in place during the withdrawal stroke, and a similar pin, (not shown), operates similarly thereto at the other selvage. Groove 62 extends along the length of needle 10 from aperture 18 to approximately the junction of the reciprocable member 12 and needle 10. Groove 62 is formed as a helical path around needle 10 to accomodate the path assumed by the strand as can be seen in FIGS. 3 and 5.

Similar to pulley 20, pulley 30 consists of disk-like element 31 which is fixed to shaft 32, and shaft 32 is journaled in bearings 33 and 34 which are suitably located in components 51 and 50 respectively. The axes of rotation of pulley 20 and 30 are substantially parallel.

Figure 4:
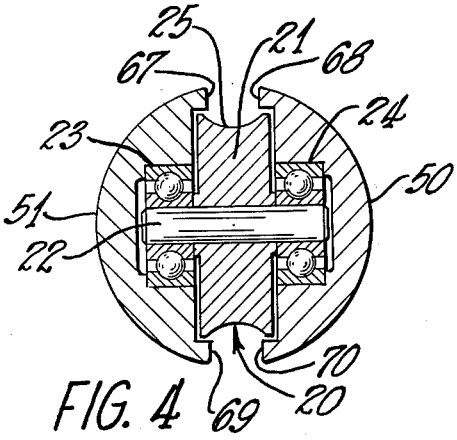
FIG. 4 is a sectional view taken along section line 4—4 of FIG. 2 showing in detail the alignment of various components in the embodiment of FIG. 2.

Disk-like elements 21 and 31 have circumferential grooves 25 and 35 for receiving the weft yarn 16. As can be seen in FIGS. 3 and 4, shoulders 67, 68, 69 and 70 overlap or extend inwardly over a portion of elements 21 and 31. These shoulders are close enough to the circumference of the disk-like elements at the zones of yarn contact to reduce or eliminate the tendency of the weft yarn to wedge between the components 50 and 51 and the disk-like elements 21 and 31; that is, the clearance between the shoulders and the circumference of the disk-like elements is substantially less than the thickness of the weft yarn.

While any suitable material can be employed in the construction of the needle, it has been found that when fiberous glass strand is used as the weft yarn it preferable to employ a stainless steel disk-like element.

It is apparent that, within the scope of the invention, modifications and different arrangements can be made other than as herein disclosed. The present disclosure is merely illustrative with the invention which comprehends all variations thereof.

I claim:

1. In a carrier for inserting weft yarn into a shed formed between warp yarns on a loom wherein the weft yarn is continuously supplied from a source located outside of the shed and is inserted into the shed by a carrier attached to a reciprocable inserter, the improvement comprising a pair of rotatably mounted pulleys positioned in said carrier, the first of said pulleys being adapted for contact with said weft yarn during motion of the carrier in a first direction, the second of said pulleys being adapted for contact with the weft yarn during motion of the carrier in a second opposite direction.

2. The carrier of claim 1 wherein one of said pulleys is adapted for contact with the weft yarn during motion of the carrier in the first and second directions.

3. The carrier of claim 2 wherein said pulleys are completely recessed within the carrier.

4. A yarn carrier comprising:

a needle-like element; and a pair of rotatable members positioned in said carrier, one of said members being positioned for contact with said yarn during motion of said carrier in a first direction and one of said member being positioned for contact with said yarn during motion of said carrier in a second opposite direction.

* * * * *